United States Patent [19]

Tait et al.

[11] Patent Number: 4,922,682

[45] Date of Patent: May 8, 1990

[54] APPARATUS AND METHOD FOR SEALING AND BANDING CAPSULES

[75] Inventors: Charles N. Tait, Manheim; Ralph A. Volpe, Landisville, both of Pa.

[73] Assignee: Warner-Lambert Company, Morris Plains, N.J.

[21] Appl. No.: 144,122

[22] Filed: Jan. 15, 1988

[51] Int. Cl.[5] ..... B65B 51/02; B65B 51/20

[52] U.S. Cl. ..... 53/139.3; 53/329; 53/900

[58] Field of Search ..... 53/329, 900, 478, 560, 53/139.3, 131; 156/308.4, 308.6

[56] References Cited

U.S. PATENT DOCUMENTS

| | | | |
|---|---|---|---|
| 3,200,556 | 8/1965 | Ackley | 53/900 X |
| 4,584,817 | 4/1986 | Yamamoto et al. | 53/900 X |
| 4,756,902 | 7/1988 | Harvey et al. | 53/478 X |
| 4,761,932 | 8/1988 | Harvey et al. | 53/329 |
| 4,793,119 | 12/1988 | Maso | 53/900 X |
| 4,802,323 | 2/1989 | Garris et al. | 53/900 X |

*Primary Examiner*—Horace M. Culver

*Attorney, Agent, or Firm*—Daniel A. Scola, Jr.; Craig M. Bell

[57] ABSTRACT

A capsule sealing and banding machine (10) and method in which capsules (C) are supplied from a supply hopper (23) to a rotating capsule transfer plate (12) for banding and sealing of the capsules as they pass over sets of sealing and banding wheels (63) at angularly-spaced-apart sealing and banding stations (13 and 15, respectively). The machine has an improved capsule feed means (30) for feeding the capsules from the hooper to the transfer plate, including a resilient gate (46) at the discharge end of the feed means, and a pivoted gate (43) at the discharge end of the hopper. In addition, independent variable speed drive means (M,62) is connected with the sealing and banding wheels, and the reservoirs (65 and 66) for the sealing and banding fluids are mounted on slides (67) for easy removal. Improved capsule transport trays (17) have hemispherical recesses (56) therein for supporting the capsules at their ends.

7 Claims, 11 Drawing Sheets

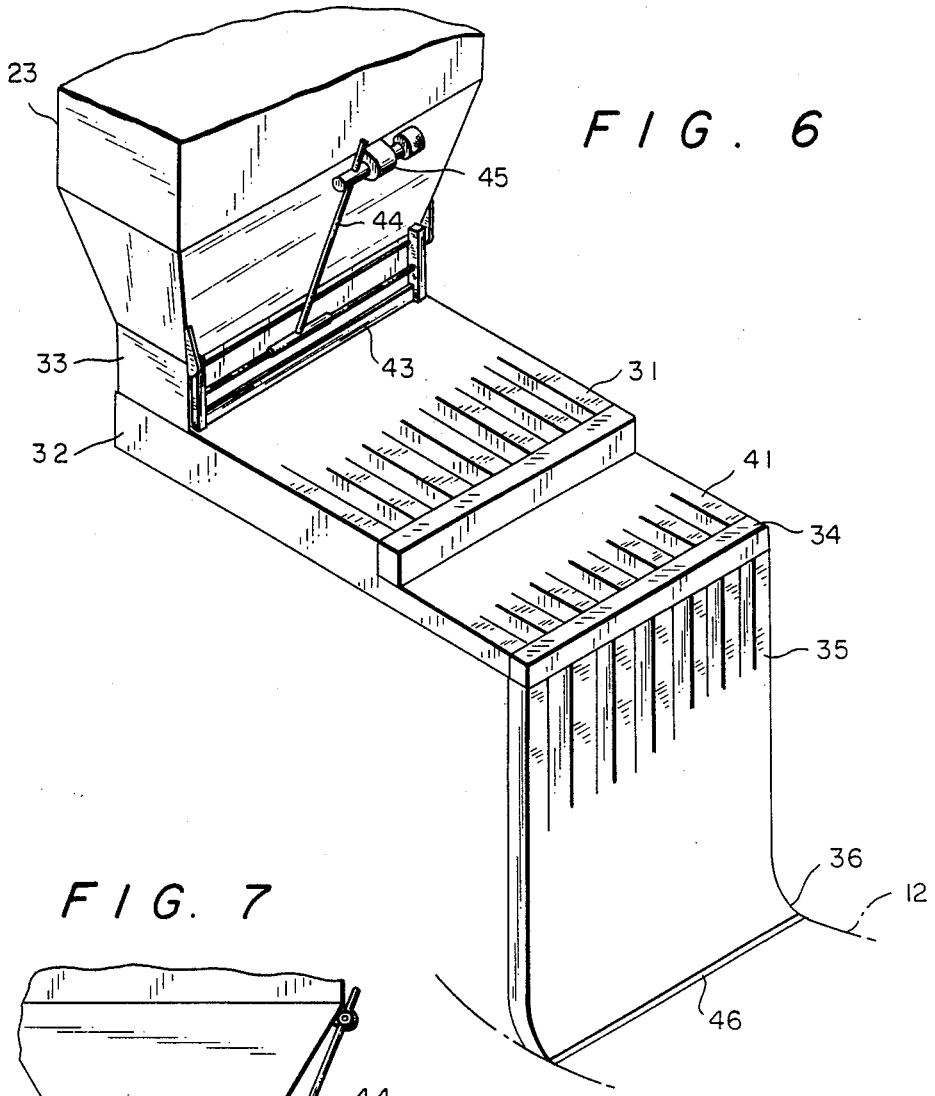
FIG. 6
FIG. 7
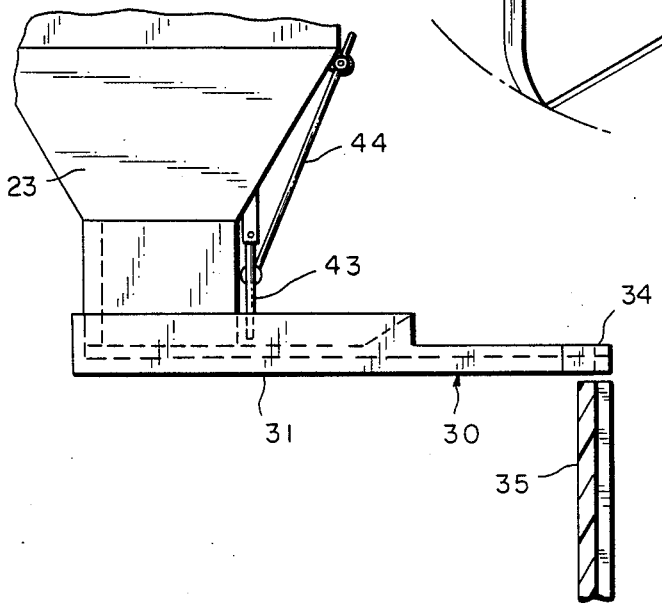

APPARATUS AND METHOD FOR SEALING AND BANDING CAPSULES

BACKGROUND OF THE INVENTION

This invention relates to capsule sealing and banding machines, and, more particularly, to a capsule sealing and/or banding apparatus and method with improved capsule feed means, capsule heating/drying means, capsule drying trays, and drive means.

PRIOR ART

One manner of protecting gelatin capsules from tampering has been the placing of a gelatin band formed in situ around the juncture of a capsule cap and body after the capsule has been filled. Commonly owned U.S. patent application Ser. No. 869,748, filed June 2, 1986, by Harvey, et. al., now abandoned discloses a liquid sealing process for joining gelatin capsule segments which can also be performed on machines used conventionally for capsule banding. When performed on such a banding machine, this process involves the replacement of the fluid gelatin used for banding with a sealing fluid mixture comprising alcohol, e.g. ethanol and water, heated to a temperature of 40° C. to 60° C. The fluid is applied by contacting the juncture between cap and body with the solution from a reservoir conventionally filled with gelatin and positioned below the banding table by means, e.g., of a print wheel. One of the variants contemplated by the Harvey, et. al., application is the sequential application of both a sealing fluid and a banding fluid on the same machine.

In conventional banding and/or sealing machines, the capsules are fed from a supply hopper to a rotating banding table or product transfer plate via a complex set of cams, levers and push rods. This capsule feed structure has a large number of moving parts, is difficult to adjust, prone to wear and difficult to maintain in proper adjustment. Moreover, any breakdown in the feed apparatus is time-consuming and expensive to repair, and the nature of the capsule feed structure limits the number of capsule banding stations or slots which can be provided on the transfer plate. For example, one typical prior art capsule banding machine in widespread use has only six tracks or banding slots in the transfer plate.

Further, in a conventional banding or sealing machine the capsules are conveyed by the banding table or product transfer plate to a plurality of capsule-receiving outlet transport trays which convey the capsules through a curing chamber to be cured or dried and thence to a suitable outlet or collection point. In one typical machine, these trays comprise elongate, curvilinear, trough-like devices which support the capsules on their sides. With this arrangement, the sealing material on the capsule engages the tray and may be damaged before it becomes fully dry.

Additionally, in prior art machines it is necessary to at least partially disassemble the machine in order to remove the pot or reservoir containing the sealing or banding fluid.

In other prior art machines, the capsule feed means which supplies capsules to the transfer plate incorporates rigid means to regulate the movement of capsules from the discharge end of the feed means to the transfer plate. Although it functions satisfactorily, this arrangement may result in jamming of the capsules or damage to them.

DISCLOSURE OF THE INVENTION

In accordance with the present invention, an improved capsule sealing and banding apparatus and method incorporate means for applying both a sealing fluid and a banding fluid to the capsule, and include a novel feed structure for feeding the capsules from the supply hopper to the transfer plate where sealing and/or banding operations are to be performed. This improved feed structure includes resilient means on the discharge end of the feed means, tending to reduce incidents of jamming and facilitating supply of the capsules to the transfer plate.

It is apparent that the apparatus is useful as an improved capsule banding machine in certain of its aspects, i.e., those wherein a single reservoir is used, and the invention is also designed to apply to the banding machine concept.

In a particular embodiment of the invention described herein, a capsule sealing station is operatively associated with the transfer plate immediately following the point where capsules are fed by the feed means to the plate, and a suitable sealing fluid, such as the ethanol and water mixture noted previously is applied to the juncture of the capsule body and cap to seal the capsule cap and body together and form a unitary capsule structure.

Supplemental capsule heating and drying means may be associated with the capsule transfer plate downstream of the sealing station to heat the sealing fluid and capsule to at least partially cure the sealed joint. The heating means heats the capsules by convection heating via a fluid medium such as air, heated by electrical radiant heat and circulated through the supplemental heating and drying means.

In the invention as described herein, a capsule banding station follows the supplemental heating means for applying a banding fluid to the capsule.

Additionally, improved capsule transport trays are provided in the capsule curing chamber. The trays have means for supporting the capsules essentially only at their ends, thereby keeping the midportion of the capsules, where the sealing and banding fluids have been applied, from touching the support surface.

Further, in the machine of the invention, the reservoirs or pots which contain the sealing and banding fluids are mounted on slides for easy removal of the reservoirs and without requiring disassembly of the machine, and the banding and sealing wheels for applying the banding and sealing fluids are driven by an independent, flexible, variable speed drive.

It should be understood that the novel capsule feed means, capsule transport trays and independent, flexible, variable speed drive for the banding and/or sealing wheels all have utility whether only one or both of the capsule sealing and banding operations as described herein are incorporated in the machine.

BRIEF DESCRIPTION OF THE DRAWINGS

Further objects, features and advantages of the invention will become apparent upon consideration of the following detailed description in conjunction with the drawings, in which like reference characters designate like parts throughout the several views, and wherein:

FIG. 6 is a fragmentary front perspective view of the capsule feed means of the invention;

FIG. 7 is a fragmentary view in side elevation, with parts shown in section, of the machine of the invention;

BEST MODE FOR CARRYING OUT THE INVENTION

Figure 1:
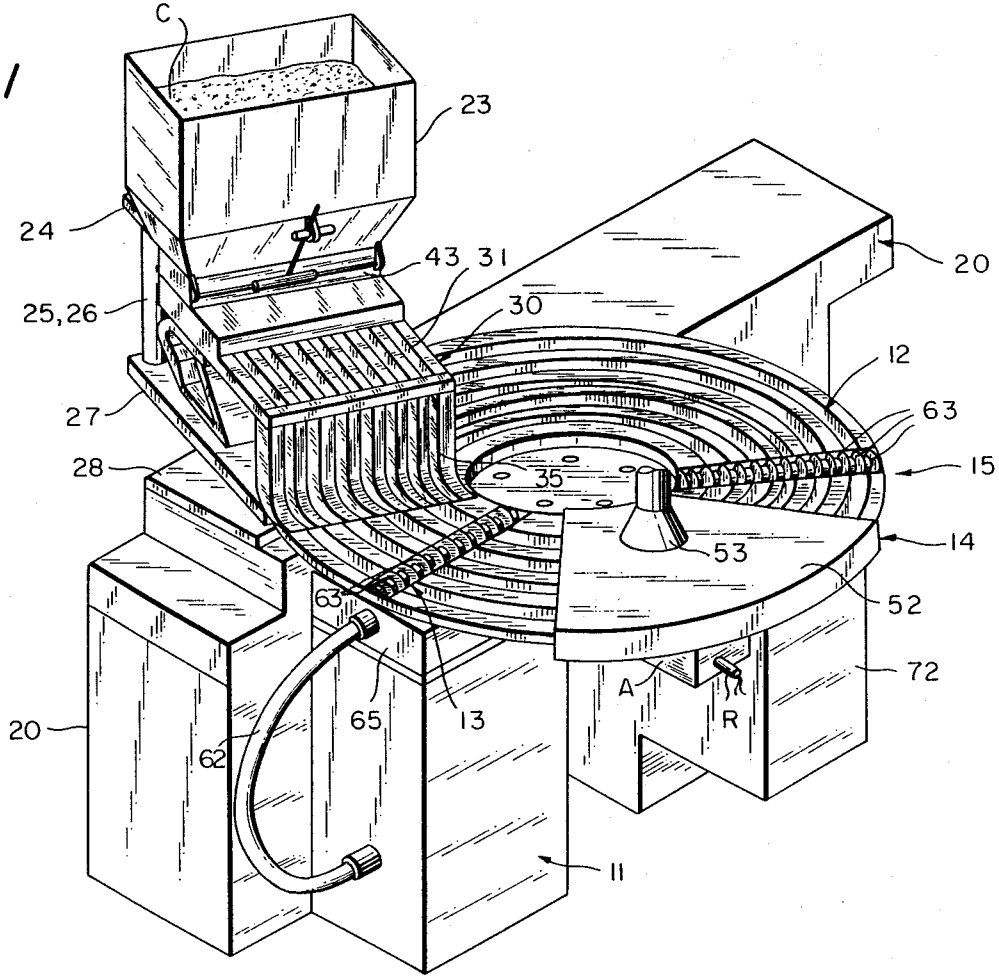
FIG. 1 is a top, front perspective view of the machine of the invention.
Figure 2:
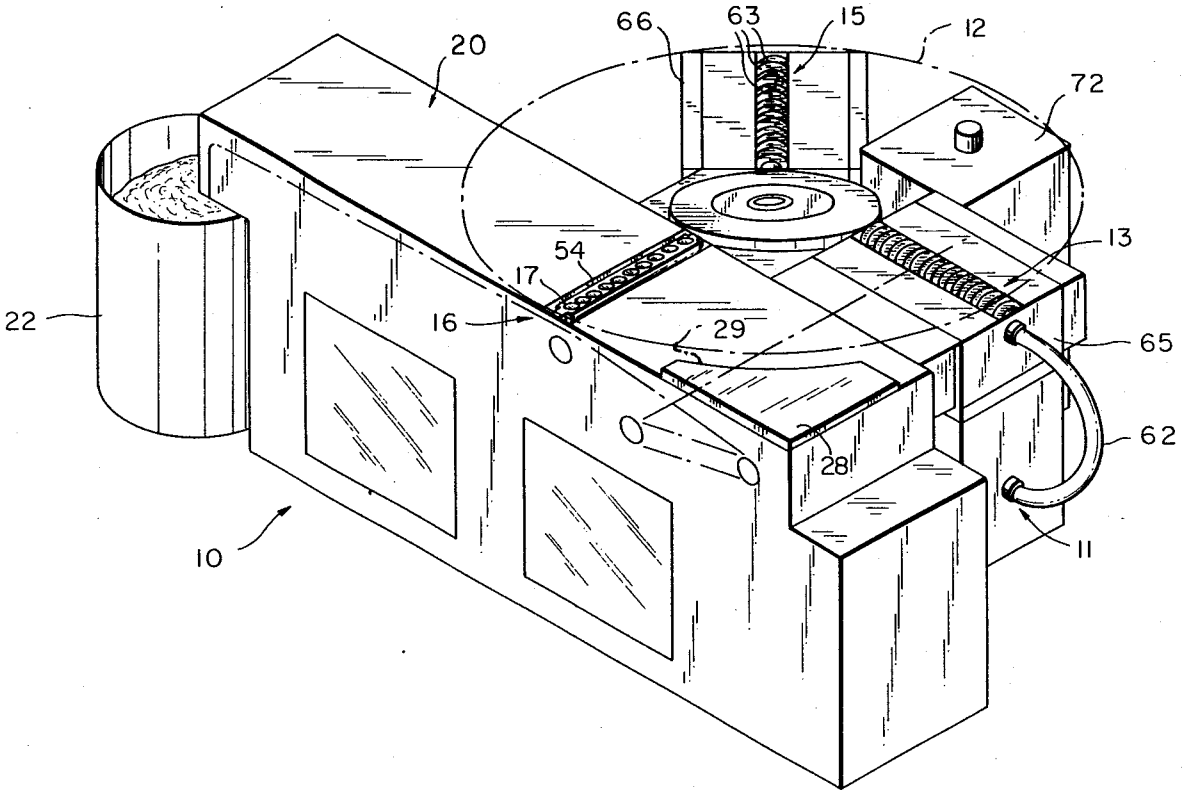
FIG. 2 is a top, rear perspective view of the machine of the invention, with portions removed for the purpose of clarity.

Referring more specifically to the drawings, a capsule sealing and banding machine is indicated generally at 10 in FIG. 1. The sealing and banding machine comprises a housing 11 on which is supported a rotating product transfer plate or banding table 12 for moving capsules C past a capsule sealing apparatus 13 and thence through a heating/drying chamber 14 for at least partially drying and curing the sealing fluid to form a unitary capsule cap and body structure. Thereafter, the transfer plate conveys the capsules past a banding apparatus 15 for application of a banding fluid such as gelatin. The sealed and banded capsules are then conveyed by the transfer plate 12 to a discharge station 16, where the capsules are picked up by product transport trays 17. The product transport trays 17 are carried by suitable conveying means such as chains 18 or the like disposed about a plurality of drive and idler sprockets 19 arranged so that the trays are moved through a serpentine path in capsule curing/holding chamber 20. At the discharge end of the chamber, the trays 17 are carried by the chains past a trip device 21 lying in their path, whereby the capsules carried thereon are dislodged or dumped from the trays and into a suitable receptacle 22.

Capsules C to be sealed and banded are placed in a hopper 23 supported above the machine at one end of a support plate 24. The support plate is attached at one end to a pair of upright stanchions 25 and 26 secured at their lower ends to one end of a mounting plate 27, which is, in turn, secured on top of a base plate 28. The base plate 28 is attached to the top surface of the housing 11, and has a radiused cut-out 29 to provide clearance for the transfer plate 12. The base plate and mounting plate are adjustable to accurately position the capsule feed means 30 relative to the transfer plate.

The capsule feed means 30 is shown in greater detail in FIGS. 5 through 10 and comprises a first slotted feed and guide section 31 having one end 32 positioned beneath a lower open end 33 of the hopper 23 to receive capsules therefrom. A capsule rectifier 34 may be mounted to the outlet end of the guide section 31, as more fully described in U.S. Pat. No. 4,761,932. A second slotted feed and guide section or down chute 35 extends substantially vertically downwardly from the outlet end of the first section and the lower, discharge end 36 thereof is laterally offset so that the slots 37 therein are angularly disposed relative to the plane of the plate 12. In one preferred embodiment, the slots subtend an angle of about 40° with the plane of the plate 12. In addition, the bottom most end of each slot 37 is cut out or enlarged at the side thereof which defines an obtuse angle with the plane of the plate 12. This enlarged area 38 defines a space into which each capsule moves as it reaches the bottom end of the slot, whereby the capsules assume a horizontal position with their longitudinal axes arranged parallel to the planes of the plate 12 and the down chute 35. Thus, with reference to FIGS. 8 and 9, the capsules are properly oriented and deposited into the capsule-receiving pockets 40 formed in the transfer plate 12. Cover plates 41 and 42 are secured over the slotted guide sections 31 and 35 to contain the capsules in the slots. These cover plates may be transparent and may have access slots therein in registry with the slots in the feed and guide sections so that any capsules which might jam in the feed slots may be observed and dislodged.

Referring to FIGS. 6 and 7, a hinged gate 43 is pivotally mounted to the bottom of the hopper for controlling movement of capsules from the hopper and into the first guide section 31. An adjustment lever 44 is connected at one end to the gate and extends at its other end through a clamp 45, whereby the longitudinal position of the lever, and thus the pivoted position of the gate can be varied or reset. This gate functions in the nature of a screen and prevents capsules from piling up in the slots.

Figure 8:
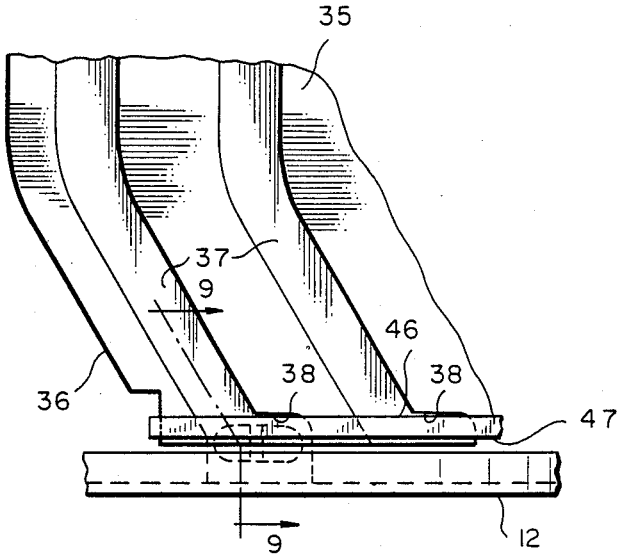
FIG. 8 is an even further enlarged fragmentary view in front elevation of the discharge portion of the capsule feed means of the invention.
Figure 9:
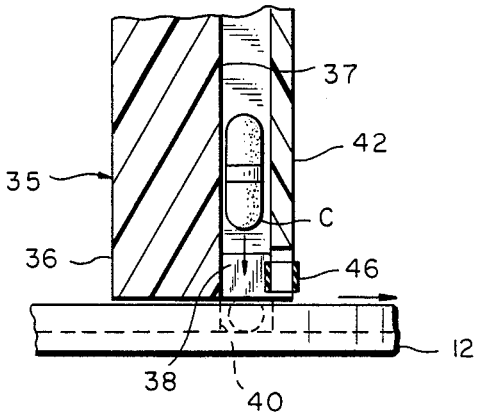
FIG. 9 is a still further enlarged fragmentary sectional view taken along line 9—9 in FIG. 8.
Figure 10:
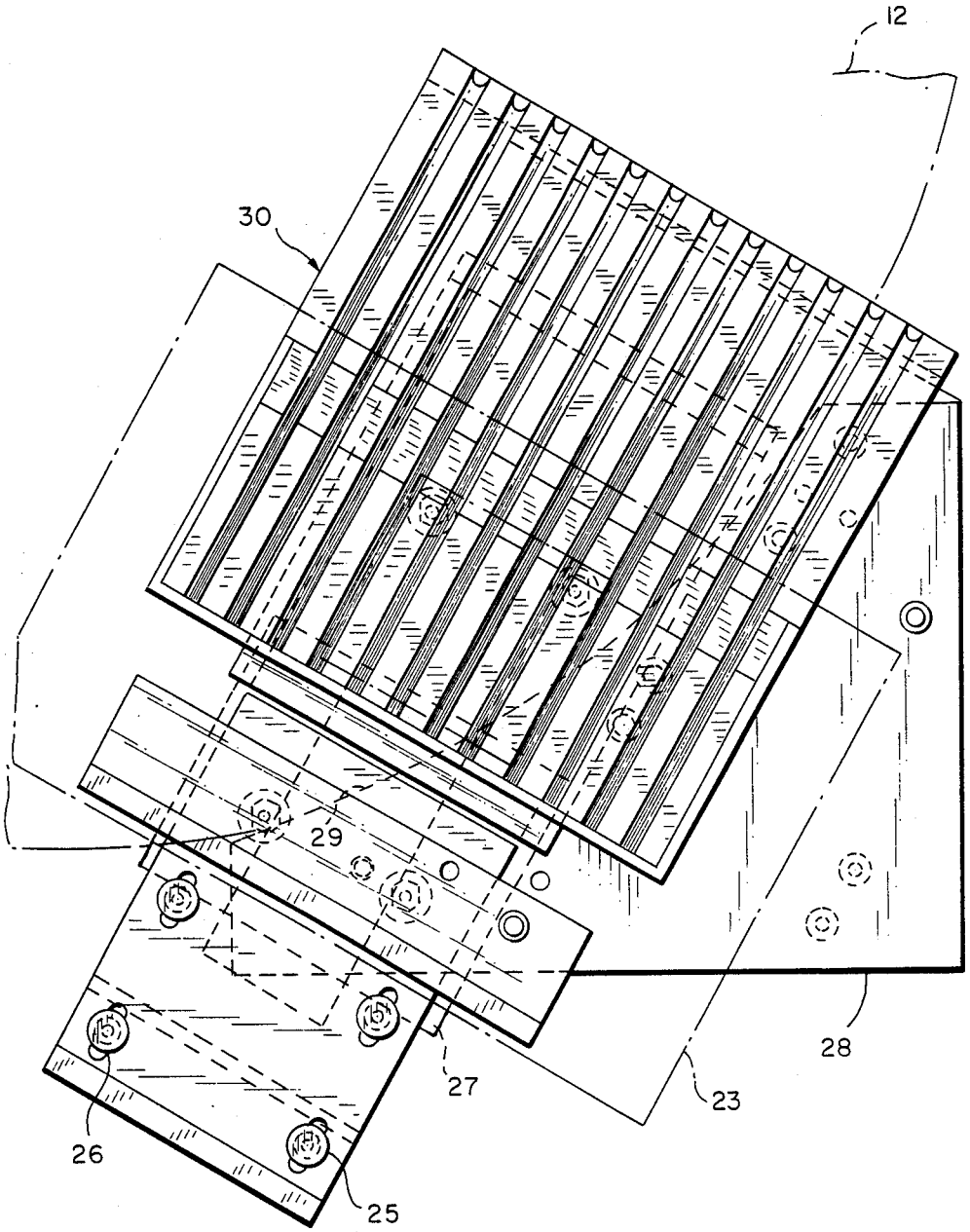
FIG. 10 is a greatly enlarged fragmentary plan view of a portion of the capsule feed means and mounting plate structure.

Referring to FIGS. 8 and 9, a flexible band 46 is engaged around the lower end of the cover plate 42, with the lower side edge 47 of the flexible band spaced above the transfer plate 12 a distance calculated to just clear the capsules as they exit the guide section 35 and enter the pockets in the transfer plate. The resiliency of the flexible band enables it to make yielding, limited movement to accommodate slightly misaligned capsules, thereby preventing jamming of or damage to the capsules as they enter the transfer plate.

Figure 5:
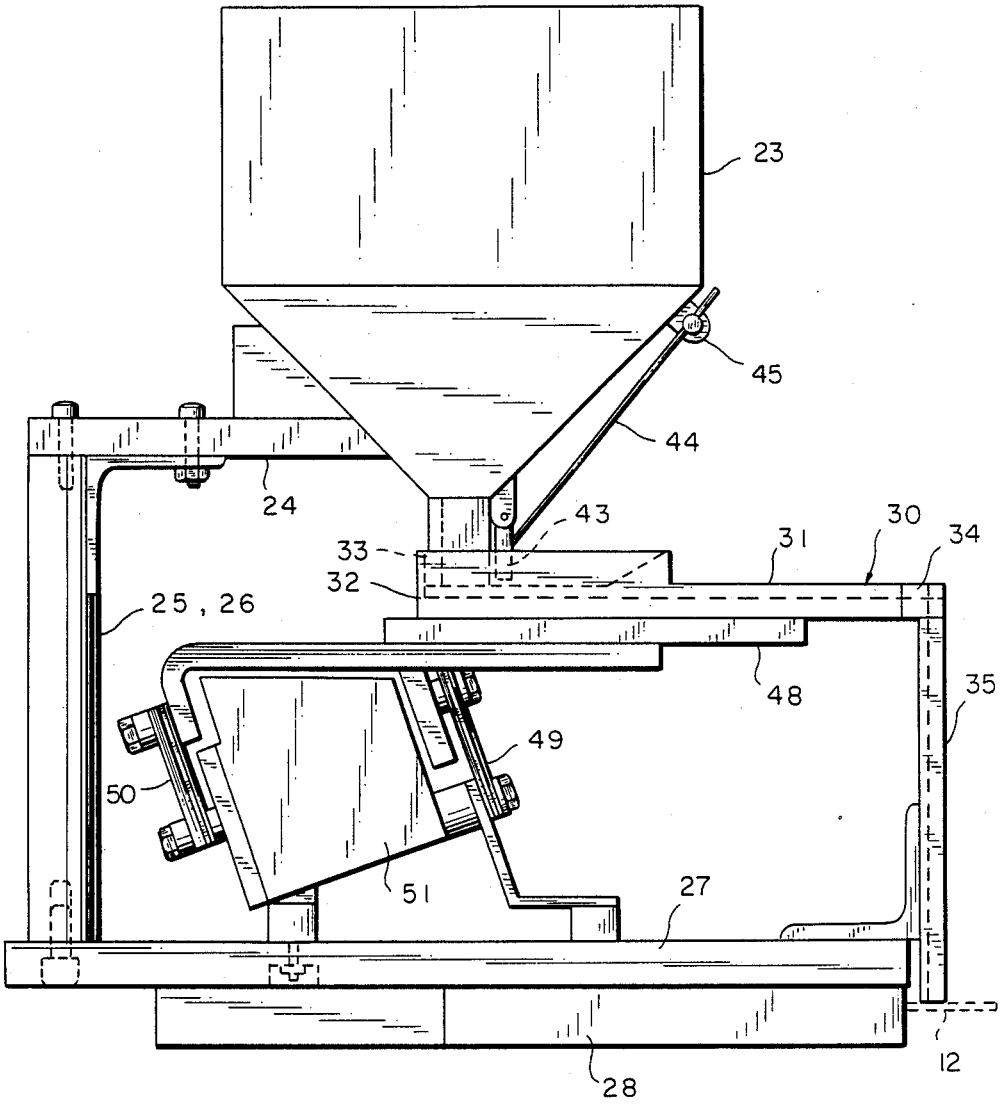
FIG. 5 is a greatly enlarged view in elevation of the capsule feed means of the invention.

With reference now to FIG. 5, the first guide section 31 is carried by a support plate 48 which is connected through resilient mounts 49 and 50 to a vibrator 51, whereby a high frequency, low amplitude vibration is imparted to the guide section 31 to promote movement of capsules along the slots in the guide section. The vibrator, in turn, is attached to the mounting plate 27.

FIGS. 1, 2, 3 and 4 show best the relationships of the various capsule handling components of the machine.

The capsule sealing station 13 is placed as close as possible to the point where the capsules are supplied to the transfer plate from the capsule feed and guide means (approximately 30° in the example shown) and the heating/drying chamber 14 is placed as close as possible to the capsule sealing station (approximately 20° in the example shown). The drying chamber 14 should not be so close to the sealing station 13 that it interferes with the application of the sealing solution to the capsules, but it must be close enough that heat is not lost from the capsule sealing solution.

The capsule banding station 15 immediately follows the heating/drying chamber 14 and is approximately 135° from the sealing station. With this arrangement, serial sealing and banding of the capsules are accomplished on the machine.

It is important to note that the heating/drying chamber 14 utilizes convection heating to at least partially cure the sealing material applied to the capsules at the sealing station. In the example shown, air heated by electrical resistance radiant heating means R is caused to flow by suitable means A over the capsules enclosed within the hood 52 and is exhausted through outlet 53. The rate of air flow through the hood, the temperature to which it is heated and the time for which the capsules are subjected to the heated air flow may all be selected to accommodate different sealing fluids and other variables for individual cases. For instance, the speed of the transfer plate 12 as well as the sealing solution used could affect the above process conditions.

From the heating/drying chamber 14, the capsules are conveyed by the transfer plate 12 past the banding station 15 and thence to the discharge station 16 at the top of the curing/holding chamber 20. At this station the capsule transport trays 17 are elevated in their path of movement (see FIG. 4) so that they engage and remove the capsules from the transfer plate through an opening 54 in the top wall of curing/holding chamber 20. Thereafter, the chains 18 and thus the capsule transport trays 17 and capsules carried thereby are caused to move through a serpentine path as they advance through the curing/holding chamber 20. Warm air is caused to circulate through this chamber to thoroughly dry and cure the banding and sealing fluids applied to the capsules. As noted previously, after the capsules have been conveyed through their serpentine path in the curing/holding chamber they move past a "trip" or "dump" station 21, where the trays engage an abutment 55 and are caused to pivot about a longitudinal axis, dumping the capsules carried thereby into a suitable receptacle 22.

The capsule transport trays 17 are shown in greater detail in FIGS. 14 through 18. In the example shown, the trays are approximately 28 centimeters long and have twelve hemispherical recesses 56 uniformly spaced along the top surface thereof. The recesses will accommodate several different sizes of capsules, including sizes #3 and #4. An axially extending pivot mount 57 projects from each of the opposite ends of the tray for pivotally attaching the tray to the chains 18 via pins 58 which are attached to the chains and extend into pivot openings 59 in the ends of the pivot mounts. An air port 60 communicates through the bottom of the recess with a cone or funnel shaped entry section 61 in the bottom of the tray, whereby upwardly flowing air in the curing chamber 20 is guided into the entry section and thence upwardly through port 60 and past the capsule held in the recess 56. This results in circulation of drying air completely around the capsule, ensuring thorough drying of the sealing and banding fluids. The air may be circulated by suitable means B. With this unique construction of the transport tray, the capsules are supported at their ends, while remaining free to move about and rotate around their longitudinal axis, exposing all sides to the drying air. Moreover, by being supported at their ends (virtually a point contact) the banding and sealing fluids do not contact any of the supporting surface and thus are enabled to thoroughly dry and/or cure without likelihood or danger of being damaged from contact with a part of the machine.

The tray may be made from any suitable material, including plastics and metals and may be stamped, molded or otherwise suitably formed. For use in the application described herein, the tray must be non-alcohol absorbent, non-wetting, rigid and capable of withstanding temperatures of up to about 140° F. As shown best in FIGS. 15, 17 and 18, the center of gravity CG of the trays 17 is below the pivot attachments, whereby the trays are suspended or hang in an upright position during their movement through the curing chamber.

Another important feature of the invention is the utilization of an independent, variable speed cable drive 62 and motor M for the capsule banding wheels 63. Thus, the speed of rotation of the wheels 63 need not be dependent upon the speed of rotation or indexing of the transfer plate 12 but can be independently set to obtain a desired result. Moreover, the flexible cable 62 can be easily disconnected from the shafts 64 on which the wheels 63 are carried, enabling the fluid reservoirs or pots 65 and 66 which carry the sealing and banding fluids, respectively, to be removed from the machine. In fact, the cables can be left connected to the reservoirs for limited movement of the reservoirs.

Figure 3:
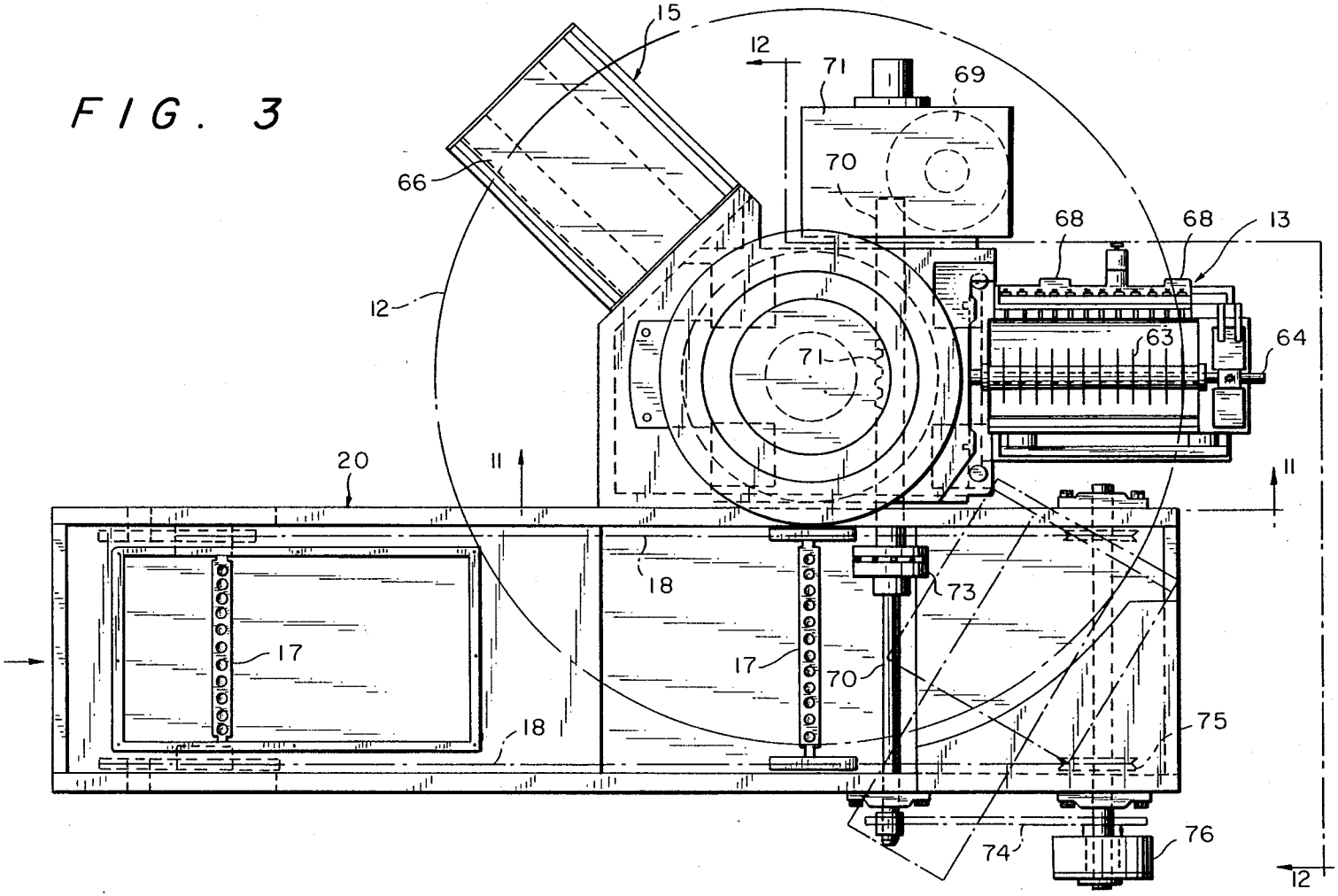
FIG. 3 is a plan view of the machine, with portions shown in section and portions removed for clarity.
Figure 4:
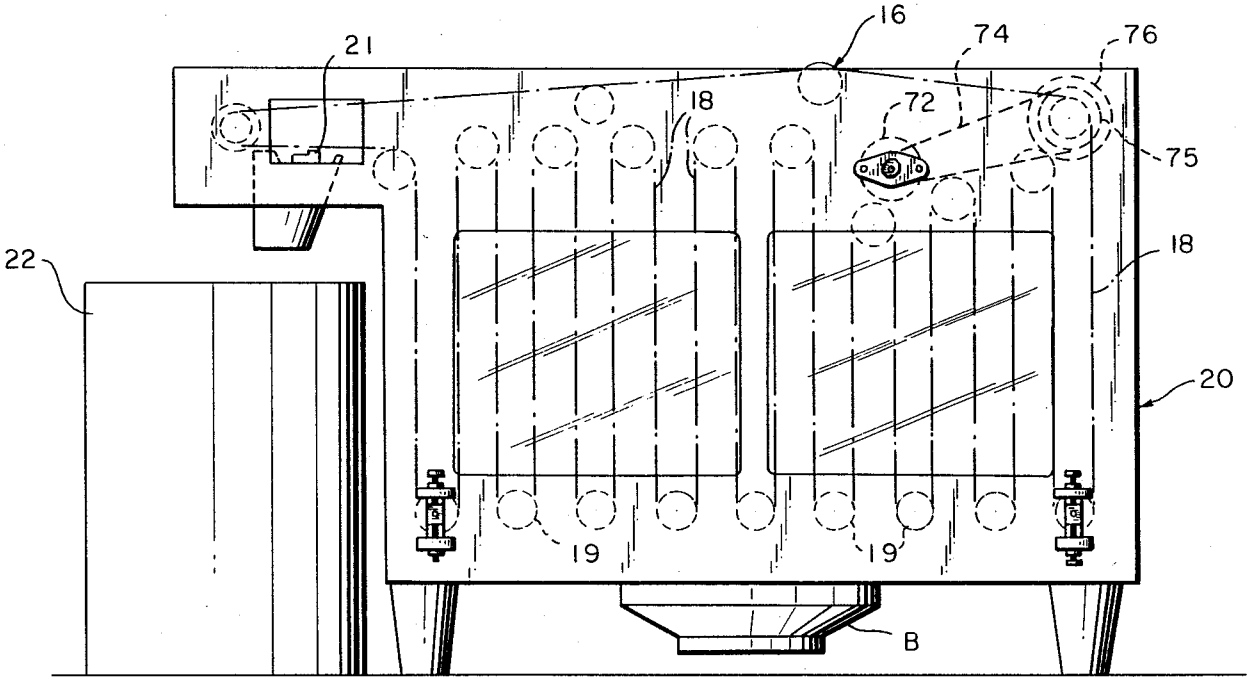
FIG. 4 is a rear side view in elevation of the machine of the invention, with portions removed.
Figure 11:
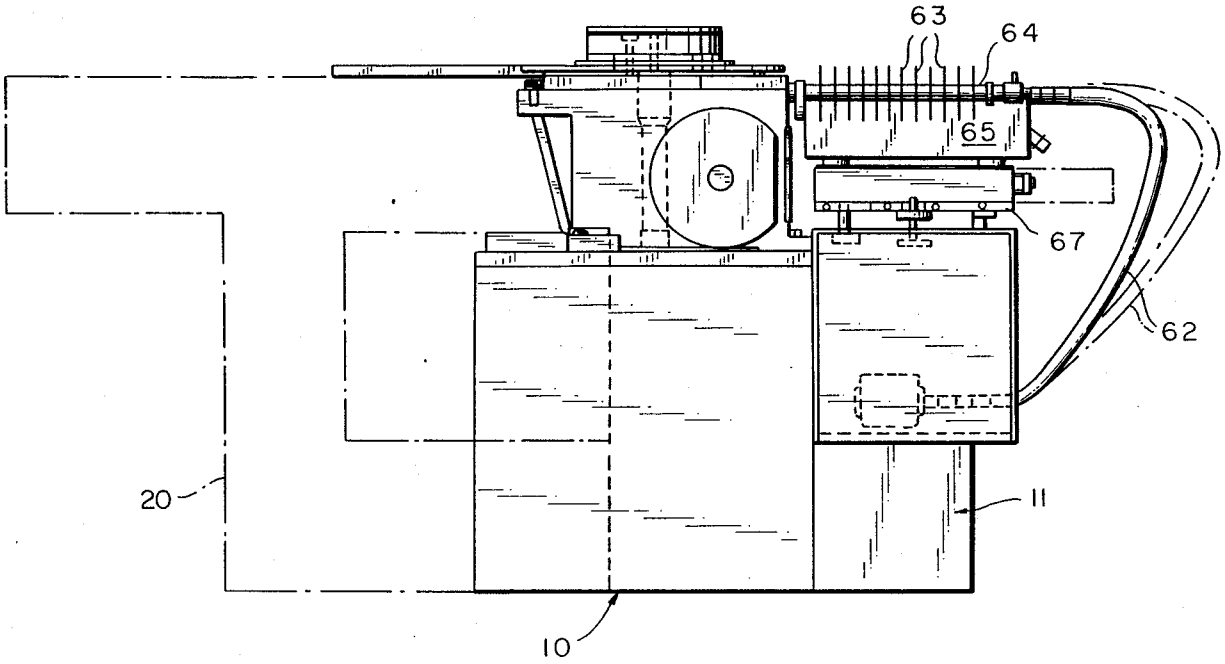
FIG. 11 is a view in section taken along line 11—11 in FIG. 3.
Figure 12:
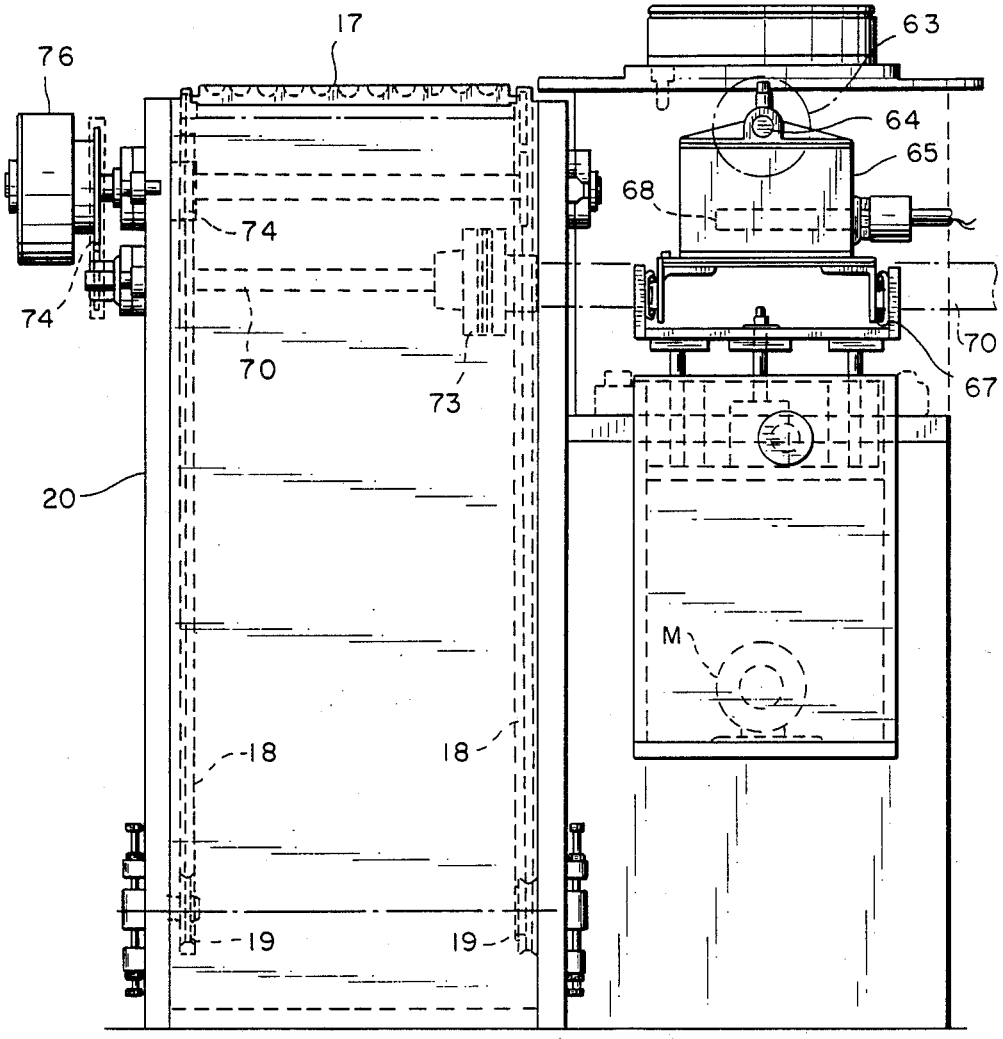
FIG. 12 is a sectional end view in elevation taken along line 12—12 in FIG. 3.
Figure 13:
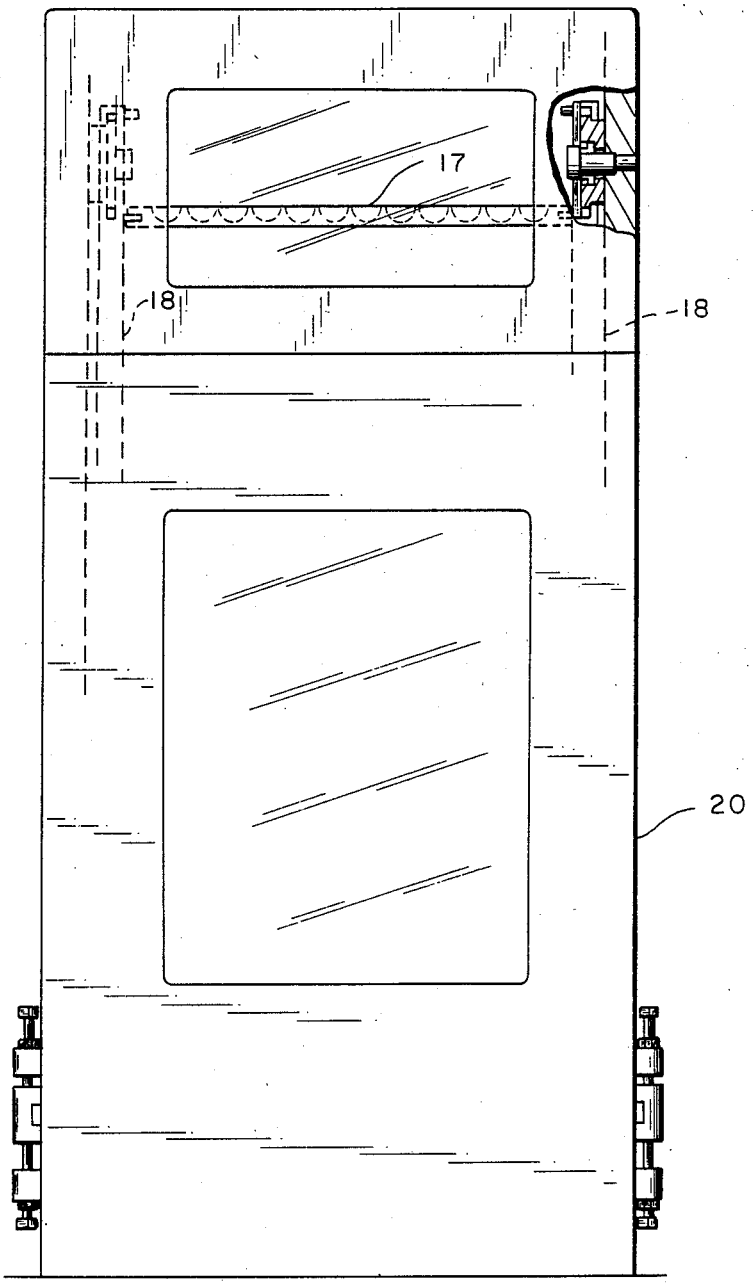
FIG. 13 is an end view in elevation taken in the direction of the arrow 13 in FIG. 3
Figures 14, 15, 16, 17, 18:
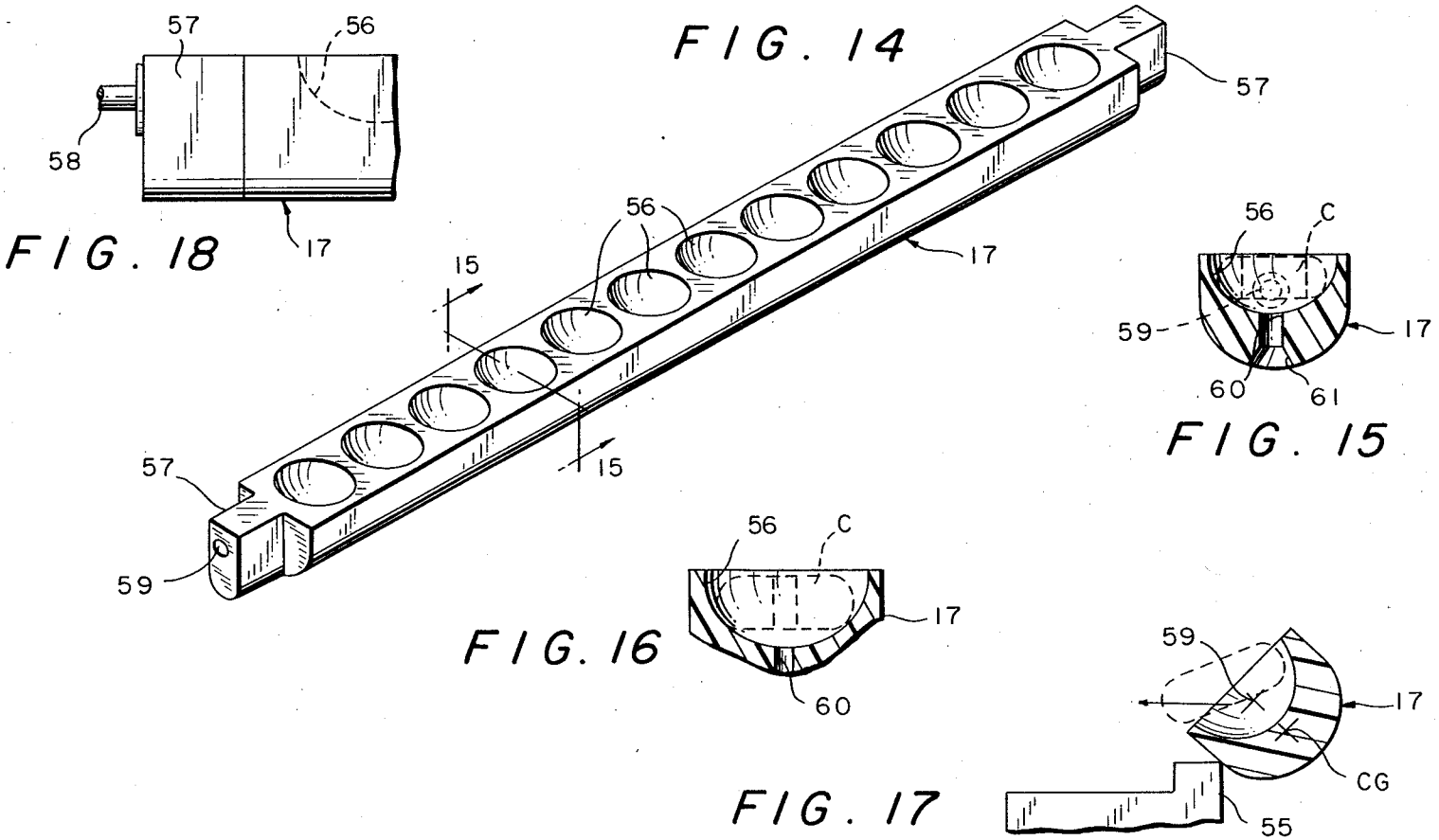
FIG. 14 is an enlarged perspective view of the capsule transport tray of the invention.
FIG. 15 is a transverse view in section taken along line 15—15 in FIG. 14.
FIG. 16 is an enlarged fragmentary view in section of the tray of FIG. 14, showing how a capsule or other object is supported at its ends in the tray.
FIG. 17 is a somewhat schematic view showing how the capsule tray engages the trip device at the discharge point from the drying chamber in order to dislodge capsules from the tray and into a suitable receptacle.
FIG. 18 is an enlarged, fragmentary view in elevation of an end portion of the tray of FIG. 14.

As seen best in FIGS. 3, 11 and 12, the fluid reservoirs 65 and 66 are mounted on slides 67 to facilitate removal of the reservoirs, banding wheels and associated components for service, etc. Suitable heater means 68 are associated with the fluid reservoirs for heating the sealing and banding solutions contained therein.

With further reference to FIGS. 3, 11 and 12, the main drive motor 69 for the transfer plate 12 and transport trays 17 is connected via shaft 70 and an indexing cam 71 to the drive for the plate 12, whereby the plate is indexed incrementally rather than moving continuously. In the particular machine described, the plate makes 72 incremental movements per minute, with each increment of movement being equal to approximately 2.54 centimeters. The indexing cam (Camco unit) 71 is connected to the motor 69 through a reducer 72.

The shaft 70 continues past the indexing cam and through the curing chamber 20, and is connected via a torque coupler 73 and chain drive or the like 74 with a drive sprocket 75 which carries and drives the chains 18 on which the transport trays 17 are supported. The chains 18 and capsule transport trays 17 move continuously in timed relationship to the indexing movement of the transfer plate 12, and this timed movement may be adjusted by means of the torque coupler 73. Additionally, the speed of rotation of the drive sprocket 75 for the chains 18 is reduced via reducer 76. In the particular embodiment described herein, the drive sprocket 75 rotates at 9 rpm versus 18 rpm for the shaft 70.

The curing/holding chamber 20 may be unbolted from the main housing, if desired, as shown in FIG. 11. This enables different curing/holding chambers to be easily and quickly substituted for one another. This feature may utilized, for example, to substitute capsule transport trays designed to accommodate different size capsules.

Although the invention has been described with reference to particular embodiments, it is to be understood that these embodiments are merely illustrative of the application of the principles of the invention. Numerous modifications may be made therein and other arrangements may be devised without departing from the spirit and scope of the invention, such as for a capsule banding machine as previously described.

We claim:

1. In a machine for applying a banding or sealing fluid to a capsule, said machine having capsule supply means, means for applying one of a capsule sealing and banding fluid to the capsule, and capsule curing means, and wherein a rotating capsule transfer plate receives the capsule from the capsule supply means and conveys them past the means for applying a sealing or banding fluid and to the capsule curing means, the improvement comprising:

capsule heating and drying means associated with the capsule transfer plate and defining an enclosed chamber through which the plate moves, said chamber being disposed immediately after a sealing means for applying a sealing fluid and before a banding means for applying a banding fluid whereby sealed capsules are conveyed by the plate through the chamber for heating and drying of the sealing fluid to at least partially cure the capsule seal, said capsule heating and drying means including means for circulating a heated fluid medium such as air over the capsules in the chamber, and including heating means for heating the fluid medium.

2. In a machine as claimed in claim 1, wherein:

said means for applying a capsule sealing fluid and a capsule banding fluid comprises a first capsule sealing means for applying a sealing fluid; and capsule banding station positioned after said heating and drying means and in the path of movement of capsules carried by the capsule transfer plate to apply a banding fluid to the capsules.

3. In a machine as claimed in claim 2, wherein:

the capsule curing means comprises a curing and holding chamber positioned to receive capsules from the capsule transfer plate, capsule transport means in said chamber for receiving the capsules from the transfer plate and conveying them through the chamber, and means for circulating a curing medium such as heated air through the chamber to dry and cure capsules carried therethrough.

4. In a machine as claimed in claim 2, wherein:

the capsule banding means and the capsule sealing means each comprise a plurality of rotating capsule banding wheels positioned to rotate in planes parallel to the paths of movement of the capsules carried by the capsule transfer plate, with a peripheral portion of each wheel disposed in the path of movement of a respective capsule, whereby as the capsule passes a wheel it is engaged by the wheel and caused to rotate about its longitudinal axis for application of banding fluid to the capsule from the wheel; and independent variable speed drive means is connected with the wheels for rotation of the wheels independently of rotation of the transfer plate and for adjustment of the speed of rotation of the wheels independently of the speed of rotation of the transfer plate.

5. In a machine as claimed in claim 7, wherein:

the independent variable speed drive means comprises a motor and a flexible drive cable connected between the motor and the wheels.

6. In a machine as claimed in claim 1, wherein:

the capsule supply means includes a hopper for containing a supply of capsules to be banded, and capsule feed means extending between the hopper and the capsule transfer plate, said capsule feed means comprising a first slotted plate having one end positioned to receive capsules from the hopper and extending substantially horizontally from the hopper at its other end, a second slotted plate having one end positioned beneath said other end of the first slotted plate and extending substantially vertically therefrom into close proximity at its lower end with the transfer plate, and cover plates secured over the slotted plates to confine the capsules to the slots therein, the cover plate which is secured over the second slotted plate having a notched lower end for passage of capsules from the slotted plate onto the transfer plate; and a resilient band positioned around the lower end of the second slotted plate in registry with the notches therein, said resilient band having a lower side edge spaced above the transfer plate a distance just sufficient to clear a capsule as it leaves the feed means and enters the transfer plate, whereby movement of capsules from the feed means to the transfer plate is facilitated.

7. In a machine as claimed in claim 10, wherein:

a pivotally adjustable gate is mounted on the hopper at the lower end thereof to control flow of capsules from the hopper to the first slotted plate, the pivoted position of the gate being adjustable through a selectively releasable clamping means connected thereto.

* * * * *